US010858794B2

(12) United States Patent
Ferraiolo

(10) Patent No.: US 10,858,794 B2
(45) Date of Patent: Dec. 8, 2020

(54) SACK FOR THE REALISATION OF CIVIL ENGINEERING WORKS, PROCESS FOR ITS MANUFACTURE, AND FOR THE REALISATION OF A WORK BY MEANS OF SEVERAL SACKS OF THIS TYPE

(71) Applicant: OFFICINE MACCAFERRI S.P.A., Zola Predosa (IT)

(72) Inventor: Francesco Ferraiolo, Ca' De' Fabbri (IT)

(73) Assignee: OFFICINE MACCAFERRI S.P.A., Zola Predosa (IT)

( * ) Notice: Subject to any disclaimer, the term of this patent is extended or adjusted under 35 U.S.C. 154(b) by 0 days.

(21) Appl. No.: 16/469,293

(22) PCT Filed: Dec. 13, 2017

(86) PCT No.: PCT/IB2017/057885
§ 371 (c)(1),
(2) Date: Jun. 13, 2019

(87) PCT Pub. No.: WO2018/109684
PCT Pub. Date: Jun. 21, 2018

(65) Prior Publication Data

US 2020/0032472 A1 Jan. 30, 2020

(30) Foreign Application Priority Data

Dec. 14, 2016 (IT) ..... 102016000126498

(51) Int. Cl.
*E02B 3/10* (2006.01)
*B65D 30/04* (2006.01)
(Continued)

(52) U.S. Cl.
CPC ..... *E02B 3/127* (2013.01); *B65D 29/02* (2013.01); *E02B 3/108* (2013.01); *B65D 29/00* (2013.01);
(Continued)

(58) Field of Classification Search
CPC ..... E02B 3/108; E02B 3/127; E02B 7/005; B65D 29/02; B65D 29/04
(Continued)

(56) References Cited

U.S. PATENT DOCUMENTS 4,127,155 A * 11/1978 Hydorn ..... A45C 3/04 383/106
4,253,507 A * 3/1981 Williamson ..... B65D 88/1618 294/74
(Continued)

FOREIGN PATENT DOCUMENTS

EP 2573272 A2 * 3/2013 ..... E02B 3/127
EP 2573272 A2 3/2013
(Continued)

OTHER PUBLICATIONS

International Search Report issued in International Application No. PCT/IB2017/057885, in English, dated Mar. 5, 2018 (4 pages).
(Continued)

*Primary Examiner* — Frederick L Lagman
(74) *Attorney, Agent, or Firm* — Flynn Thiel, P.C.

(57) ABSTRACT

A sack for realising civil engineering works, including a sack structure with two main faces defined by two respective equal main areas of cloth that are joined over most of their periphery. The main areas of cloth define an opening for introducing filling material into the sack structure when in use. The sack includes at least one area of protective cloth whose resistance characteristics differ from the main areas of cloth. The area of protective cloth is fastened to the
(Continued)

outside of the sack structure so as to substantially cover a single main face thereof.

7 Claims, 2 Drawing Sheets

(51) Int. Cl.

| | |
|---|---|
| ***E02B 3/12*** | (2006.01) |
| ***B65D 30/08*** | (2006.01) |
| *B65D 30/00* | (2006.01) |
| *E02D 3/00* | (2006.01) |
| *E02D 17/20* | (2006.01) |

(52) U.S. Cl.
CPC ..... *D10B 2505/204* (2013.01); *E02D 3/005* (2013.01); *E02D 17/202* (2013.01)

(58) Field of Classification Search
USPC ..... 383/32, 109, 113, 119
See application file for complete search history.

(56) References Cited

U.S. PATENT DOCUMENTS

| | | | | | |
|---|---|---|---|---|---|
| 4,486,121 | A | | 12/1984 | Thompson et al. | |
| 4,629,651 | A | | 12/1986 | Davis | |
| 4,909,410 | A | * | 3/1990 | Derby | B65D 88/1612 383/111 |
| 5,199,795 | A | * | 4/1993 | Russo | B65D 81/264 206/204 |
| 5,499,743 | A | * | 3/1996 | Blumenkron | B65D 88/1656 220/4.13 |
| 5,605,416 | A | * | 2/1997 | Roach | E02B 3/02 405/21 |
| 5,902,070 | A | * | 5/1999 | Bradley | E02B 3/127 112/441 |
| 6,200,067 | B1 | * | 3/2001 | Pena | E02B 3/108 405/115 |
| 6,524,670 | B1 | * | 2/2003 | Kataoka | B32B 9/02 206/204 |
| 2002/0168227 | A1 | * | 11/2002 | Rubin, Jr. | E02B 3/108 405/17 |
| 2004/0140041 | A1 | | 7/2004 | Glick | |
| 2007/0009327 | A1 | * | 1/2007 | Sanguinetti | E02B 3/04 405/115 |
| 2008/0138157 | A1 | * | 6/2008 | Kim | E02B 3/127 405/107 |
| 2009/0103981 | A1 | * | 4/2009 | Tagini | E02B 3/108 405/114 |
| 2011/0206458 | A1 | | 8/2011 | Jones et al. | |
| 2012/0027520 | A1 | * | 2/2012 | Powell | E02B 7/005 405/107 |

FOREIGN PATENT DOCUMENTS

| | | | | | |
|---|---|---|---|---|---|
| FR | 968829 | A | * | 12/1950 | E02B 3/127 |
| GB | 2438613 | A | | 12/2007 | |
| WO | WO-2005040503 | A1 | * | 5/2005 | E02B 3/127 |
| WO | WO-2007119002 | A1 | * | 10/2007 | E02B 3/04 |

OTHER PUBLICATIONS

Written Opinion of International Searching Authority issued in International Application No. PCT/IB2017/057885, in English, dated Mar. 5, 2018 (6 pages).

* cited by examiner

SACK FOR THE REALISATION OF CIVIL ENGINEERING WORKS, PROCESS FOR ITS MANUFACTURE, AND FOR THE REALISATION OF A WORK BY MEANS OF SEVERAL SACKS OF THIS TYPE

TECHNICAL FIELD

The present invention relates to the sector of civil engineering works.

BACKGROUND

The invention has been developed with particular regard, although not exclusively, to civil engineering works for the construction, protection and/or reinforcement of embankments, beaches, coasts, banks, breakwaters and hydraulic civil works in general, and also in the sector of underground or undersea works.

More particularly, although not exclusively, the invention is directed at improvements in the sector of "geobags", i.e. permeable sacks made with geotextile materials, which are usually placed side by side and/or stacked to realise civil works, for example, of the type mentioned.

Hydraulic works are particularly important in the sector of civil engineering works; they comprise, for example, the construction or reconstruction, protection and/or reinforcement of, for example, embankments, beaches, coasts, banks, breakwaters and the like. For example, it is known that the phenomenon of coastal erosion can be countered and controlled by constructing barriers against the erosive force of waves, on or along the coast. "Geobags"—sacks of geotextile material—are often used in producing these barriers.

These sacks are very versatile and are used successfully in realising a wide range of civil engineering works which, in addition to those mentioned previously, can also include undersea works such as the support or anchorage of undersea pipes, or land works such as the restoration of dunes or the reinforcement of cliffs and other works of the same nature. Before placement, the sacks are filled with a filling material, non-exhaustive and non-restrictive examples thereof being sand or soil, which are easy to locate and often available at the actual works site where the barrier is being constructed. Once they are filled, the protective sacks are closed and positioned as per the civil works design. In particular, the sacks have the property of adapting to the shape of the terrain and, together with other adjacent sacks, side by side or on top of each other, forming effective barriers that can be produced quickly and without the need for specialist personnel or machinery.

The sacks are generally made with a geotextile, either woven or nonwoven. The criteria for selecting among the types of geotextile are associated with performance in terms of mechanical strength, filtration, the required resistance to abrasion and, not least, the ability to resist phenomena of abrasion or atmospheric attack or UV rays, in general terms. The geotextile is normally made with polyester or polypropylene fibres or filaments. These geotextiles normally display good mechanical strength, and have variable performance in terms of resistance to UV rays, which performance leads, on average, to satisfactory results over limited periods of exposure to UV radiation. Using a geotextile for manufacturing sacks is particularly desirable, because in this way the sacks prove water-permeable and yet retain the filling materials they contain. Complete impermeabilisation of the ground covered by these sacks is therefore avoided, thereby allowing and facilitating the growth of organisms and microorganisms beneficial to the development and preservation of the natural environment. The works realised by means of these sacks therefore have a minimal ecological impact, and are helpful in preserving faunal resources, for example piscine fauna; they are therefore held in high regard when civil works are being designed, particularly in aquatic environments. Moreover, the protective works realised with these sacks have generally proved more economical than other types of barriers, for example barriers that use large concrete blocks or rocks.

The above-mentioned quality of works realised with geotextile sacks has favoured their increasing adoption and spread. Although known sacks made with high-quality geotextiles are fairly resistant from the mechanical point of view, in theory allowing the realisation of works designed for long-term resistance, practice has demonstrated that the sacks deteriorate to a certain extent, sometimes even rapidly, when they are exposed to aggressive atmospheric agents and especially when exposed to direct sunlight. Under these conditions, even though the geotextile materials with which they are manufactured are classified as materials characterised by good UV resistance, the guaranteed exposure time for maintaining acceptable operational performance is unlikely to exceed twelve months, which means that the works require regular maintenance, possibly involving the addition of sacks or replacement of damaged sacks, or even the complete reconstruction of the works.

Another problem encountered in works realised with traditional "geobag"-type sacks is the risk of the works collapsing and becoming contaminated not only by atmospheric events that might rupture the sacks, for example extreme temperatures, UV rays, frost, acid rain and other natural phenomena, but also human action such as the discharge—accidental or otherwise—of polluting, inflammable or toxic substances onto the sacks in the civil works.

In the light of the above-mentioned problems, there is a particular need, in the sector of civil engineering works, to find a solution to the problem of ensuring that the works carried out have a substantial life, by using "geobag" type sacks.

SUMMARY

The purpose of the present invention is therefore to resolve the problems of the prior art, and in particular to improve the resistance of "geobag"-type sacks, to ensure that works realised with such sacks have a substantial lifetime. Another purpose of the invention is that of improving the resistance of "geobag"-type sacks without thereby sacrificing the characteristics for which they are valued, including their easy placement without the need for specialist personnel or machinery, and their permeability, which ensures a low environmental impact. The purpose of the invention is also to provide sacks that are economical and practical in production and use.

In order to achieve the above-mentioned objectives, the invention has as its subject-matter a sack for realising civil works having the characteristics indicated in the following claims. The invention also has as its subject-matter a protective structure realised with a plurality of said sacks. The invention also has as its subject-matter a method for realising a protective structure using a plurality of such sacks, and also a method for manufacturing such protective sacks.

According to a first aspect, a description is given of a sack for realising civil engineering works, comprising a sack structure with two main faces. These two faces are defined by two respective equal main areas of cloth, joined together over most of their periphery, for example on three sides in the case of main areas of cloth with a rectangular shape. The main areas of cloth define an opening suitable for introducing filling material into the sack when in use. The sack comprises at least one area of protective cloth whose resistance characteristics differ from the main areas of cloth. This area of protective cloth is fastened to the outside of the sack structure so as to substantially cover a single main face thereof.

The area of protective cloth can be made using an impermeable cloth, while at least the main area of cloth that defines the main face opposite the main face to which the area of protective cloth is fastened is made of a permeable material. Advantageously, the area of protective cloth has much greater resistance to UV rays than that of the main areas of cloth, said resistance being quantifiable in particular as classes of resistance expressed as years of exposure to UV rays. Preferably, the area of protective cloth is a large piece of waxed cloth.

The main areas of cloth can be made of geotextile and preferably, but not exclusively, of the same geotextile. In this case, the main areas of cloth can advantageously be made with a single cloth of geotextile material folded into two equal-sized portions.

Preferably, the main areas of cloth and the area of protective cloth are joined together over most of their periphery by stitching.

According to another aspect, a description is given of a method for manufacturing a sack intended for realising civil engineering works, having one or more of the above-mentioned characteristics. The method comprises the phases of

- having available two equal main areas of cloth;
- having available an area of protective cloth whose dimensions are substantially equal to the main areas of cloth;
- superimposing the two main areas of cloth so as to form a sack structure with two main faces defined by the two respective equal main areas of cloth;
- superimposing the area of protective cloth over one of the two main areas of cloth, so that it ends up on the outside of the sack structure;
- joining together the main areas of cloth and the area of protective cloth over most of their periphery so that the areas of main cloth define an opening for introducing filling material into the sack structure when in use, and such that the area of protective cloth is fastened to the outside of the sack structure so as to substantially cover a single main face thereof.

Preferably, the main areas of cloth and the area of protective cloth are joined together by stitching.

According to another aspect, a description is given of a method for realising civil engineering works by means of a plurality of sacks having one or more of the above-mentioned characteristics. The method comprises the phases of:

- having available a plurality of such sacks;
- filling the sacks with a filling material;
- closing the sacks;
- placing the sacks side by side and/or stacked on one another such that the area of protective cloth of each sack is positioned on the outside of the civil engineering works.

BRIEF DESCRIPTION OF THE DRAWINGS

Further features and advantages will become apparent from the following detailed description of a preferred embodiment, with reference to the accompanying drawings, given purely by way of non-restrictive example, in which.

DETAILED DESCRIPTION

Figure 1:
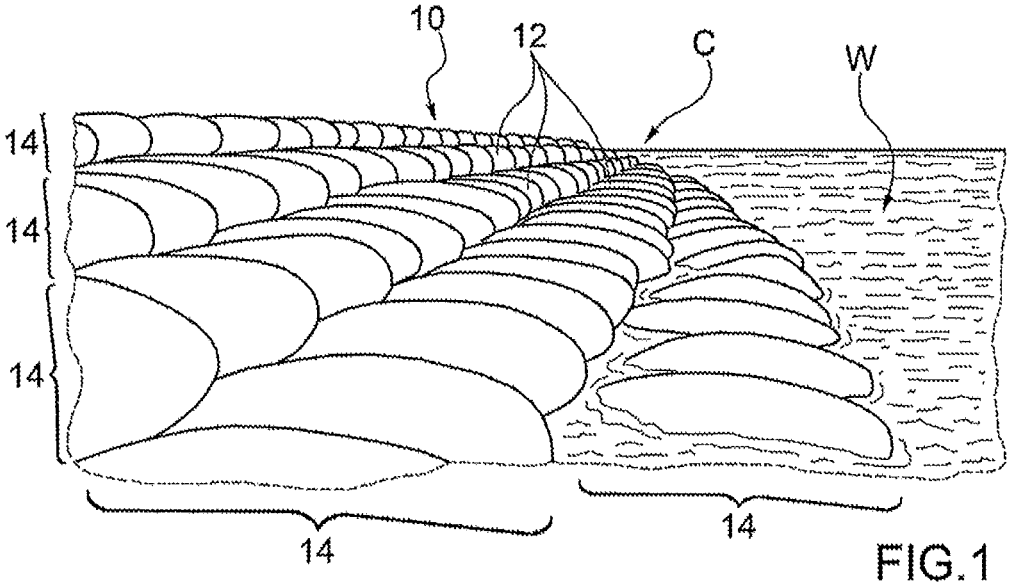
FIG. 1 shows diagrammatically in perspective a coastal protection barrier realised by means of a plurality of protective sacks incorporating aspects of the invention, arranged in stacked arrays.

FIG. 1 illustrates, by way of example, a civil engineering work comprising coastal protection 10 realised with sacks 12 for protecting a coastline C of a body of water W. The sacks 12 are filled with a known type of filling material, such as sand or soil or the like, and are arranged side by side so as to form arrays 14 approximately parallel to the coastline C and arranged partially superimposed on one another, so as to form a protective structure sloping down towards the body of water W.

Figure 2:
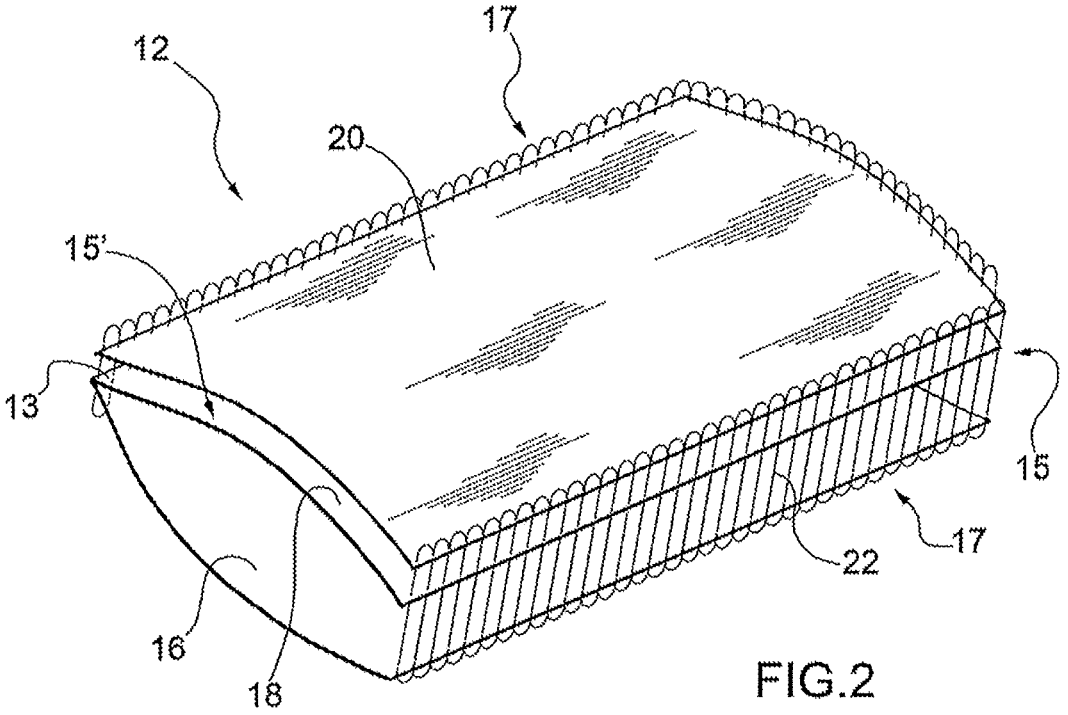
FIG. 2 is a diagrammatic perspective view of an example of a protective sack incorporating aspects of the invention, in an assembly condition.
Figure 3:
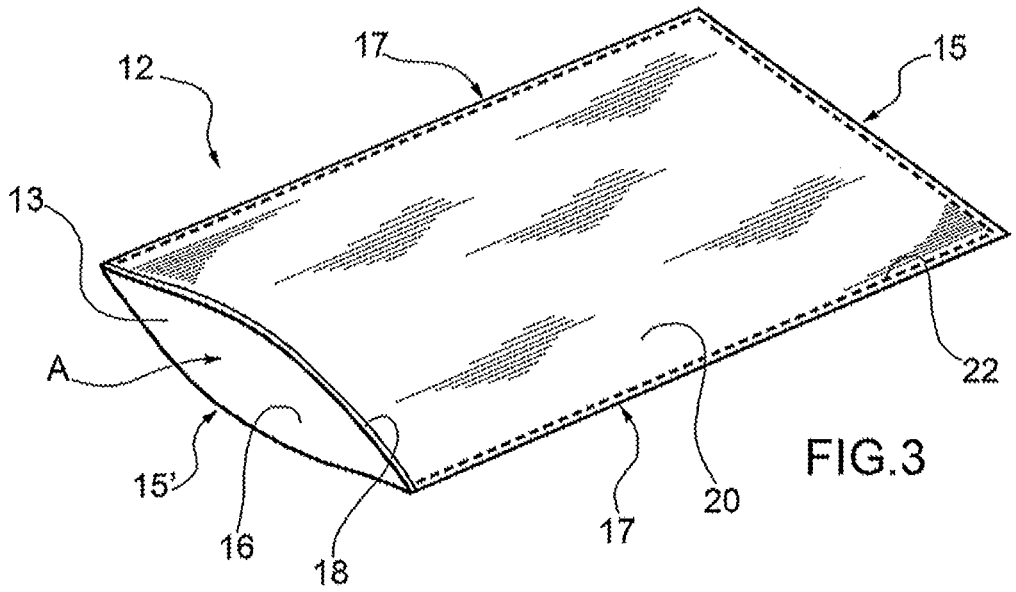
FIG. 3 is a diagrammatic perspective view similar to that in FIG. 2, illustrating the protective sack in the assembled condition, ready for filling.
Figure 4:
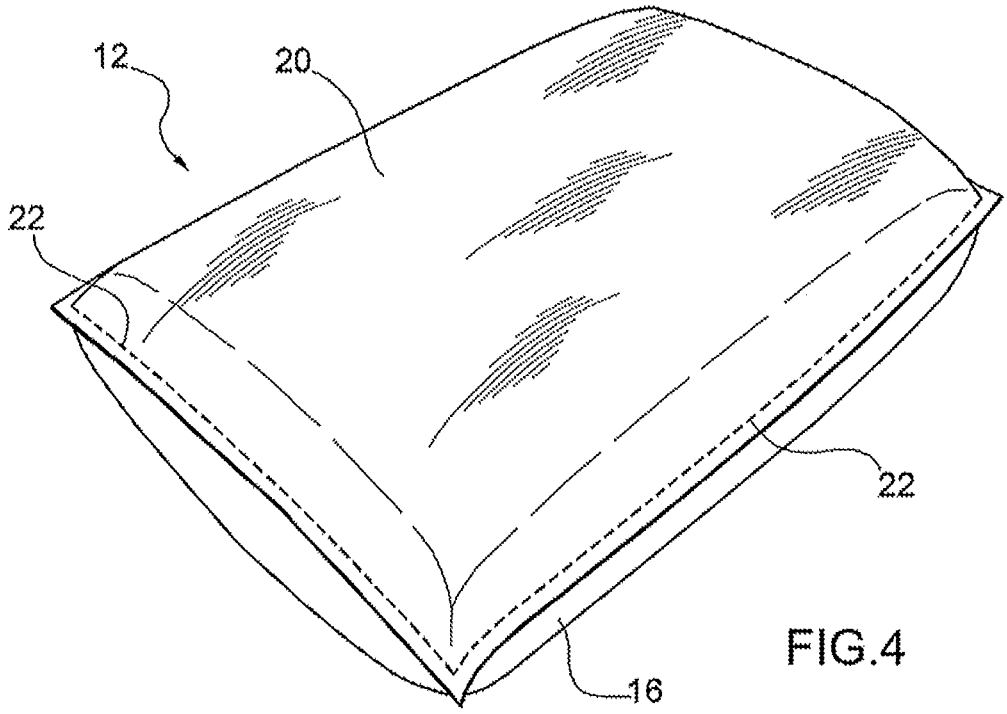
FIG. 4 is a diagrammatic perspective view similar to that in FIGS. 2 and 3, illustrating the protective sack in the filled and closed configuration, ready for installation.

With reference to FIGS. 2 to 4, a sack 12 comprises a main sack structure 13, realised with a lower cloth 16 and an upper cloth 18, preferably made of the same geotextile, although this does not exclude the possibility of using different cloths in particular cases, for example a nonwoven geotextile for the lower cloth 16 and a woven geotextile for the upper cloth 18, or vice versa. In particular the upper cloth 18 could also be made of a material other than geotextile. Where the material of the lower cloth 16 and the upper cloth 18 is the same, the main sack structure 13 can be produced with a single cloth, folded in half to form the lower cloth 16 and the upper cloth 18 already joined on one side, for example a short side 15 or a long side 17. Preferably, the geotextile used for the lower cloth 16 and the upper cloth 18 is a high-resistance woven geotextile, made of polyester or polypropylene.

The sack 12 further comprises a protective cloth 20 positioned on top of the upper cloth 18, outside the main sack structure 13. The protective cloth 20 is made with a preferably impermeable material. The protective cloth 20 preferably has high resistance to UV rays. The protective cloth 20 is preferably a large piece of impermeable waxed cloth, for example made with an impermeable laminated textile having a certain, desirable resistance to UV rays. The dimensions of the protective cloth 20 are substantially equal to those of the upper cloth 18, so as to cover it completely. The protective cloth 20 can be joined to an already existing sack 12, or more preferably can be fastened to the lower 16 and upper 18 cloths at the time of manufacturing the sack. In this case, it is advantageous to join the two lower 16 and upper 18 cloths and the protective cloth 20 in a single stitching operation. When joining the cloths to form the sack 12, it is advantageous to realise stitching 22 on three sides of the cloths, particularly on one short side 15 and two long sides 17, leaving the other short side 15' open so as to form the opening A of the main sack structure 13, intended for introducing the filling material at the time of use, before installation.

Alternatively, in a variant embodiment of the sack 12, not illustrated, the protective cloth 20 is joined only to the underlying upper cloth 18 also on the remaining short side 15', to prevent the filling material from being accidentally introduced between the protective cloth 20 and the upper cloth 18, instead of inside the main sack structure 13, between the lower cloth 16 and the upper cloth 18. In this case, the protective cloth 20 can be joined to the upper cloth 18 on the short side 15' using any of various known techniques, for example with sewing, stitches or staples, by gluing, hot-welding or other known techniques.

Before use, the sack 12 is filled with a filling material inserted into the aperture A (see FIG. 3), which is present on the side of the main sack structure 13 left suitably free of the stitching 22 between the lower cloth 16 and the upper cloth 18. As stated previously, the filling material can be of various types, such as sand, soil or other material, preferably but not exclusively loose, and even more preferably locatable in situ, in the vicinity of the site where the civil engineering works are being realised. It will be appreciated that it is possible to use a different material, depending on the specific requirements of the civil engineering project to be realised with the sacks 12. For example, the sacks 12 can be filled with bituminous material, or a hydraulic mortar, or other known material. The amount of material inserted into the sack 12 is naturally commensurate with the dimensions of said sack 12, which is filled such that it is subsequently easy to close the aperture A.

At the end of filling the main sack structure 13, the aperture A is closed, for example by stitching the short side 15', previously left open. The result is visible diagrammatically in FIG. 4, which illustrates a full, closed sack 12, ready for installation in order to realise civil engineering works, for example coastal protection 10 as illustrated in FIG. 1.

The sack 12 can be provided with handles, laces, eyelets or other known components, not illustrated, to make it easier to lift the sack 12 when full and closed. The full sack is placed in such a way that the lower cloth 16 of geotextile material faces downwards, in contact with the ground or with underlying sacks, while the protective cloth 20 faces upwards or, at any rate, towards the outside of the works. The portion of sack 12 facing downwards, which is formed of a lower cloth 16, is therefore permeable, whereas the upper—or at any rate—outer portion of the sack 12, which is covered with the protective cloth 20, is impermeable and has the desired resistance to UV rays, preferably always greater or much greater than that of the lower 16 and upper 18 cloths that form the main sack structure 13.

Where the works require a number of sacks to be stacked, it is preferably for only the upper layer to be formed of sacks 12 having the protective cloth 30, while the underlying layer(s) could advantageously be realised with traditional "geobag"-type sacks. In this way the body of the works would remain completely permeable, while the upper portion or, at any rate, the outer portion of the overall works would be protected from bad weather, contaminants and UV rays owing to the presence of the protective cloths 20 on the respective sacks 12 positioned outermost.

The provision of a protective cloth 20 covering the upper cloth 18 of the main sack structure 13 has the advantage of giving the sack 12 overall resistance to UV rays, and therefore maximum life for the sack 12, greater than the resistance to sun rays of the protective cloth 20 alone. In fact, even if—with the passage of time—the protective cloth 20 should tear or become worn, the upper cloth 18 of the main sack structure 13 would, even still, independently provide protection from UV rays to a certain degree, depending on the material of the cloth itself.

It will be appreciated that, without prejudice to the principle of the invention, the embodiments and the implementation details can vary greatly from what is described and illustrated while remaining within the scope of the present invention.

The invention claimed is:

1. A sack for realising civil engineering works, the sack comprising a sack structure with two main faces defined by two respective equal main areas of cloth, made with a single cloth of a permeable geotextile material folded into two equal-sized portions and joined over most of their periphery and defining an opening for introducing filling material when in use, the sack further comprising at least one area of protective cloth having resistance characteristics differing from the main areas of cloth, the area of protective cloth being fastened to an outside of the sack structure so as to substantially cover a single main face thereof, wherein the area of protective cloth is an impermeable cloth.

2. The sack according to claim 1, wherein the area of protective cloth has a greater resistance to UV rays than that of the main areas of cloth.

3. The sack according to claim 1, wherein the area of protective cloth is a large piece of waxed cloth.

4. The sack according to claim 1, wherein the main areas of cloth and the area of protective cloth are joined together over most of their periphery by stitching.

5. A method for manufacturing a sack according to claim 1, intended for realising civil engineering works, comprising the steps of:

having available two equal main areas of cloth made with a single cloth of geotextile permeable material folded into two equal-sized portions;

having available an area of protective cloth whose dimensions are substantially equal to the main areas of cloth, the area of protective cloth being an impermeable cloth;

superimposing the two main areas of cloth so as to form a sack structure with two main faces defined by the two respective equal main areas of cloth;

superimposing the area of protective cloth over one of the two main areas of cloth, so that the area of protective cloth ends up on an outside of the sack structure; and joining together the main areas of cloth and the area of protective cloth over most of their periphery so that the areas of main cloth define an opening for introducing filling material into the sack structure when in use, and such that the area of protective cloth is fastened to the outside of the sack structure so as to substantially cover a single main face thereof.

6. The method for manufacturing a sack according to claim 5, wherein the main areas of cloth and the area of protective cloth are joined together by stitching.

7. A method for realising civil engineering works with a plurality of sacks according to claim 1, comprising the steps of:

having available a plurality of such sacks;

filling the sacks with a filling material;

closing the sacks;

placing the sacks side by side and/or stacked on one another such that the area of protective cloth of each sack is positioned on an outside of the civil engineering works.

* * * * *